US007469746B2

(12) United States Patent
Tarvin et al.

(10) Patent No.: US 7,469,746 B2
(45) Date of Patent: Dec. 30, 2008

(54) DOWNHOLE SAMPLING TOOL AND METHOD FOR USING SAME

(75) Inventors: Jeffrey A. Tarvin, Brookfield, CT (US); Julian J. Pop, Houston, TX (US); Simon H. Bittleston, Houston, TX (US); Angus J. Melbourne, Sugar Land, TX (US); Rogerio T. Ramos, Hampshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/023,605

(22) Filed: Jan. 31, 2008

(65) Prior Publication Data

US 2008/0121394 A1 May 29, 2008

Related U.S. Application Data

(63) Continuation of application No. 10/710,111, filed on Jun. 18, 2004, now Pat. No. 7,347,262.

(51) Int. Cl.
*E21B 49/10* (2006.01)

(52) U.S. Cl. ..... 166/264; 73/152.26; 166/100

(58) Field of Classification Search ..... 166/264, 166/100, 66, 113; 73/152.26
See application file for complete search history.

(56) References Cited

U.S. PATENT DOCUMENTS 2,740,477 A 4/1956 Monaghan
2,799,347 A 7/1957 Wilcox
3,121,459 A 2/1964 Van Ness, Jr. et al.
3,323,361 A 6/1967 Lebourg
3,419,089 A 12/1968 Venghiattis
3,430,711 A 3/1969 Taggart
3,611,799 A 10/1971 Davis (Continued)

FOREIGN PATENT DOCUMENTS

WO WO9630628 10/1996
WO WO03100219 12/2003

OTHER PUBLICATIONS

Breifeld, B.M. et al., "Restricted Interval Guelph Permeater: Theory and Application," Water Resources Res. vol. 36, No. 6, Jun. 2000, pp. 1373-1380.
Dinwiddie, C.L. et al., " A New Small Drill Hold Minipermeameter Probe for in Situ Permability Measurement: Fluid Mechanics and Geometrical Factors," Water Resources Rs. vol. 39, No. 1178.

*Primary Examiner*—Hoang Dang
(74) *Attorney, Agent, or Firm*—Dave R. Hofman; Darla Fonseca; Jaime Castano

(57) ABSTRACT

Methods and apparatuses for sampling fluid from a subterranean formation penetrated by a wellbore are provided. The subterranean formation has clean formation fluid therein, and the wellbore has a contaminated fluid therein extending into an invaded zone about the wellbore. A shaft is extended from a housing and positioned in a perforation in a sidewall of the wellbore. At least one flowline extends through the shaft and into the housing. The flowline(s) are adapted to receive downhole fluids through the perforation. At least one fluid restrictor, such as a packer, injection fluid or flow inhibitor, may be used to isolate at least a portion of the perforation whereby contaminated fluid is prevented from entering the isolated portion of the perforation. At least one pump selectively draws fluid into the flowline(s).

20 Claims, 7 Drawing Sheets

U.S. PATENT DOCUMENTS

| | | | |
|---|---|---|---|
| 3,934,468 | A | 1/1976 | Brieger |
| 3,952,588 | A | 4/1976 | Whitten |
| 4,246,782 | A | 1/1981 | Hallmark |
| 4,287,946 | A | 9/1981 | Brieger |
| 4,339,948 | A | 7/1982 | Hallmark |
| 4,369,654 | A | 1/1983 | Hallmark |
| 4,392,376 | A | 7/1983 | Lagus et al. |
| 4,416,152 | A | 11/1983 | Wilson |
| 4,860,580 | A | 8/1989 | Durocher |
| 4,860,581 | A | 8/1989 | Zimmerman et al. |
| 4,879,900 | A | 11/1989 | Gilbert |
| 4,936,139 | A | 6/1990 | Zimmerman et al. |
| 4,962,815 | A | 10/1990 | Schultz et al. |
| 4,994,671 | A | 2/1991 | Safinya et al. |
| 5,195,588 | A | 3/1993 | Dave |
| 5,230,244 | A | 7/1993 | Gilbert |
| 5,289,875 | A | 3/1994 | Stokley et al. |
| 5,337,821 | A | 8/1994 | Peterson |
| 5,337,838 | A | 8/1994 | Sorensen |
| 5,472,049 | A | 12/1995 | Chaffee et al. |
| 5,477,923 | A | 12/1995 | Jordan, Jr. et al. |
| 5,533,573 | A | 7/1996 | Jordan, Jr. et al. |
| 5,692,565 | A | 12/1997 | MacDougall et al. |
| 5,746,279 | A | 5/1998 | Havlinek et al. |
| 5,765,637 | A | 6/1998 | Dietle et al. |
| 5,803,186 | A | 9/1998 | Berger et al. |
| 5,934,374 | A | 8/1999 | Hrametz et al. |
| 6,047,239 | A | 4/2000 | Berger et al. |
| 6,092,416 | A | 7/2000 | Halford et al. |
| 6,148,912 | A | 11/2000 | Ward |
| 6,176,323 | B1 | 1/2001 | Weirich et al. |
| 6,178,815 | B1 | 1/2001 | Felling et al. |
| 6,223,822 | B1 | 5/2001 | Jones |
| 6,230,557 | B1 | 5/2001 | Ciglenec et al. |
| 6,301,959 | B1 | 10/2001 | Hrametz et al. |
| 2002/0020533 | A1 | 2/2002 | Tubel |
| 2004/0079527 | A1 | 4/2004 | Meister et al. |

DOWNHOLE SAMPLING TOOL AND METHOD FOR USING SAME

CROSS REFERENCE TO RELATED APPLICATIONS

This application is a continuation application of U.S. patent application Ser. No. 10/710,111, filed Jun. 18, 2004, now U.S. Pat. No. 7,347,262 the content of which is incorporated herein by reference for all purposes.

BACKGROUND OF THE INVENTION

1. Field of the Invention

The present invention relates to the evaluation of a subterranean formation. In particular, the present invention relates to sampling fluid from a subterranean formation via a downhole tool positioned in a wellbore.

2. Description of the Related Art

The collection and sampling of underground fluids contained in subterranean formations is well known. In the petroleum exploration and recovery industries, for example, samples of formation fluids are collected and analyzed for various purposes, such as to determine the existence, composition and producibility of subterranean hydrocarbon fluid reservoirs. This aspect of the exploration and recovery process can be crucial in developing exploitation strategies and impacts significant financial expenditures and savings.

To conduct valid fluid analysis, the formation fluid obtained from the subterranean formation should possess sufficient purity, or be "virgin" or "clean" fluid, to adequately represent the fluid contained in the formation. In other words, the subterranean fluid is pure, pristine, connate, uncontaminated or otherwise considered in the fluid sampling and analysis field to be sufficiently or acceptably representative of a given formation for valid hydrocarbon sampling and/or evaluation.

Various challenges may arise in the process of obtaining clean fluid from subterranean formations. Again with reference to the petroleum-related industries, for example, the earth around the borehole from which fluid samples are sought typically contains contaminates, such as filtrate from the mud utilized in drilling the borehole. This so-called "contaminated fluid" often contaminates the clean fluid as it passes through the borehole, resulting in fluid that is generally unacceptable for hydrocarbon fluid sampling and/or evaluation. Because formation fluid passes through the borehole, mudcake, cement and/or other layers during the sampling process, it is often difficult to avoid contamination of the fluid sample as it flows from the formation and into a downhole tool. A challenge thus lies in minimizing the contamination of the clean fluid during fluid extraction from the formation.

FIG. 1 depicts a subterranean formation 3 penetrated by a wellbore 4. A layer of mud cake 5 lines a sidewall 7 of the wellbore 4. Due to invasion of mud filtrate into the formation during drilling, the wellbore is surrounded by a layer known as the invaded zone 9 containing contaminated fluid that may or may not be mixed with clean fluid. Beyond the sidewall of the wellbore and surrounding contaminated fluid, clean fluid is located in a portion of the formation 6 referred to as the connate fluid zone 8. As shown in FIG. 1, contaminates tend to be located near the wellbore wall in the invaded zone 9. Clean fluid tends to be located past the invaded zone and in the connate fluid zone 8.

FIG. 2 shows the typical flow patterns of the formation fluid as it passes from subterranean formation 3 into a downhole tool 1. Examples of a downhole sampling tool are disclosed in U.S. Pat. Nos. 4,860,581 and 4,936,139, both assigned to the assignee of the present invention. The downhole tool 1 is positioned adjacent, the formation and a probe 2 is extended from the downhole tool through the mudcake 5 to the sidewall 7 of the wellbore 4. The probe 2 is placed in fluid communication with the formation 3 so that formation fluid may be passed into the downhole tool 1. Initially, as shown in FIG. 1, the invaded zone 9 surrounds the sidewall 7 and contains contamination. As fluid initially passes into the probe 2, the contaminated fluid from the invaded zone 9 is drawn into the probe with the fluid thereby generating fluid unsuitable for sampling. However, as shown in FIG. 2, alter a certain amount of fluid passes through the probe 2, the clean fluid breaks through and begins entering the probe. In other words, a portion of the fluid flowing into the probe gives way to the clean fluid, while at least a portion of the remaining portion of the fluid may be contaminated fluid from the invaded zone. The challenge remains in capturing the clean fluid in the downhole tool without contamination.

Various methods and devices have been proposed for obtaining subterranean fluids for sampling and evaluation. For example, U.S. Pat. Nos. 6,230,557 to Ciglenec et al., 6,223,822 to Jones, 4,416,152 to Wilson, 3,611,799 to Davis and International Pat. App. Pub. No. WO 96/30628 have developed certain probes and related techniques to improve sampling. Other techniques have been developed to separate clean fluids during sampling. For example, U.S. Pat. No. 6,301,959 to Hrametz et al discloses a sampling probe with two hydraulic lines to recover formation fluids from two zones in the borehole. Borehole fluids are drawn into a guard zone separate from fluids drawn into a probe zone. Despite such advances in sampling, there remains a need to develop techniques for fluid sampling to optimize the quality of the sample and efficiency of the sampling process.

Various techniques have also been employed for perforating the sidewall of a well bore and sampling therethrough. For example, U.S. Pat. No. 5,692,565 assigned to the assignee of the present invention discloses techniques for perforating the sidewall of a cased wellbore using a downhole tool with a flexible drilling shaft. Other techniques, such as those in U.S. Pat. No. 5,195,588 assigned to the assignee of the present invention, disclose the use of punching mechanisms, explosive devices and/or other tools for creating a perforation into the sidewall of a wellbore for sampling. While these techniques provide the ability to create perforations into the sidewall of the wellbore, there remains a need to sample clean fluid through the perforation.

In considering existing technology for the collection of subterranean fluids for sampling and evaluation, it is desirable to have a downhole sampling tool capable of providing one or more, among others, of the following attributes: the ability to sample with reduced contamination, selectively collect clean fluid apart from contaminated fluid, optimize the quantity of clean fluid captured, reduce the amount of time it takes to obtain clean formation samples, reduce the likelihood of contamination from fluids in the invaded zone and/or wellbore and improve the quality of clean fluid extracted from the formation for sampling. To this end, the present invention is provided

SUMMARY OF THE INVENTION

In at least one aspect, the present invention relates to a downhole sampling tool positionable in a wellbore penetrating a subterranean formation having a formation fluid therein. The wellbore has a contaminated fluid therein extending into an invaded zone about the wellbore. The downhole sampling tool includes a housing, a shaft extendable from the housing, at least one flowline extending through the shaft and into the housing, at least one fluid restrictor positioned about the perforation and at least one pump for drawing fluid into the flowline(s).

The shaft is positionable in a perforation in a sidewall of the wellbore. The flow-line is adapted to receive downhole fluids, and the cleanup flowline is adapted to receive downhole fluids. The flowline(s) may include a sampling and a cleanup flowline. The fluid restrictor(s) is(are) adapted to isolate at least a portion of the perforation whereby contaminated fluid is prevented from entering the isolated portion of the perforation. The fluid restrictor may he a packer inflatable about the shaft and/or downhole tool, a flow inhibitor inserted in the perforation about the shaft or a fluid injected into the formation to provide seal about the perforation. The shaft may also be provided with a bit adapted to penetrate the sidewall of the wellbore. Alternatively, a separate perforating device may be used to form the perforation prior to insertion of the shaft. Various aspects of the tool incorporate packers, injection fluids, tubular portions and/or flow inhibitors to isolate the sampling fluid flowing into the sampling flowline from contaminated fluid in the invaded zone.

in another aspect, the present invention relates to a method of sampling a fluid from a subterranean formation penetrated by a wellbore. The method includes inserting a shaft into a perforation in a sidewall of a wellbore, positioning at least one fluid restrictor in the perforation to isolate at least a portion of the perforation and selectively drawing downhole fluid from the perforation into the downhole tool via the flowline(s).

Finally, in another aspect, the invention relates to a probe for sampling formation fluid. The probe includes a shaft extendable from the downhole tool, at least one flowline extending through the shaft and at least one packer disposed about the shaft. The shaft is positionable in a perforation in a sidewall of the wellbore. The flowlines are adapted to receive downhole fluids. The packer is expandable to isolate at least a portion of the perforation about the shaft whereby the contaminated fluid is prevented from entering the portion of the perforation isolated by the packer.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 2:
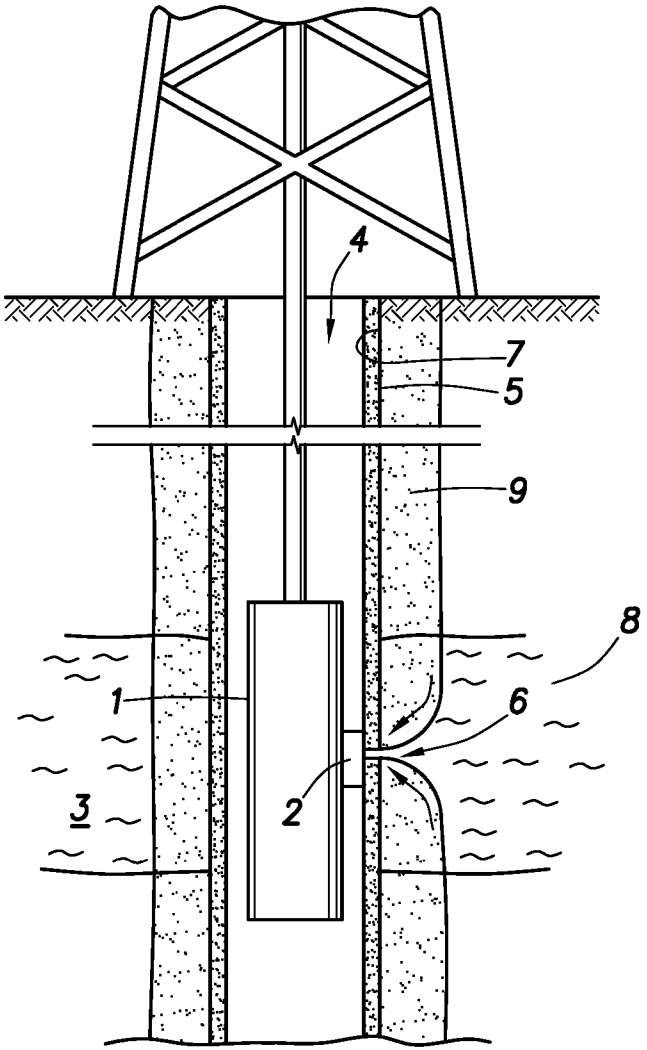
FIG. 2 is a schematic view of a downhole sampling tool positioned in the wellbore of FIG. 1 and having a probe, depicting the flow of contaminated and clean fluid into the downhole sampling tool.
Figure 1:
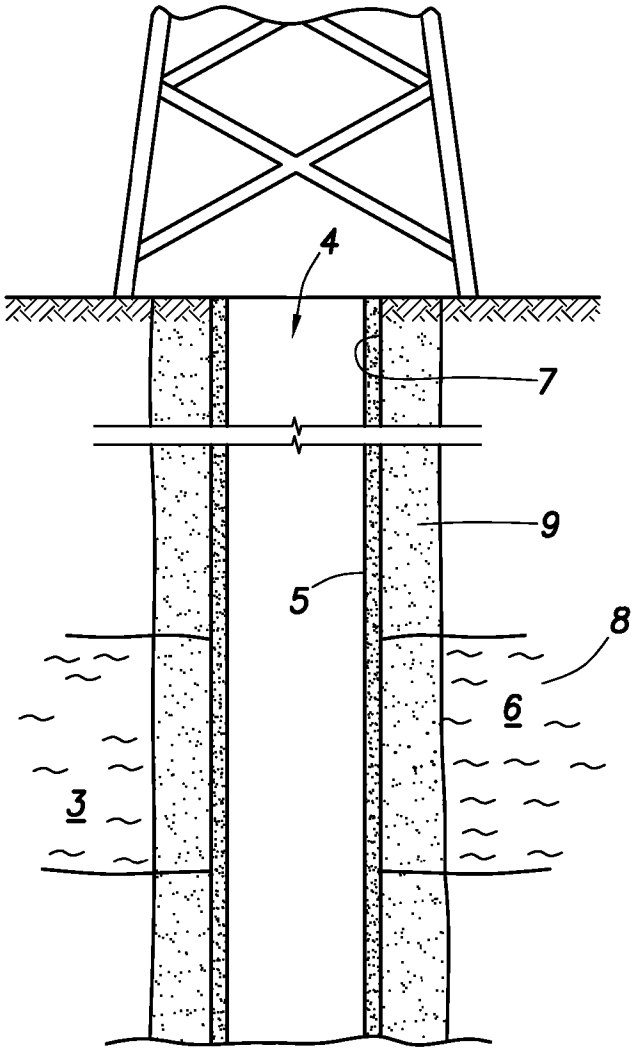
FIG. 1 is a schematic view of a subterranean formation penetrated by a wellbore lined with mudcake, depicting contaminated fluid in an invaded zone and clean fluid in a connate fluid zone of the subterranean formation.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 3:
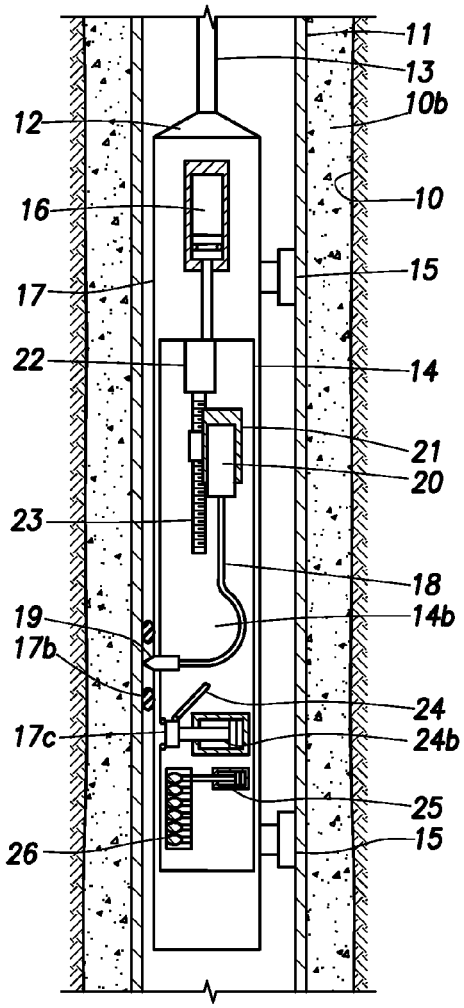
FIG.3 (PRIOR ART)
FIG. 3 is a schematic view of downhole tool positioned in a cased wellbore, the downhole tool having a perforating system for drilling through the sidewall of the cased wellbore.

FIG. 3 depicts an existing system for perforating a wellbore. This system includes a downhole tool 12 with a flexible drilling shaft 18 adapted to penetrate a cased wellbore. It will be appreciated that this tool 12 may also be used to perforate and/or penetrate a variety of wellbores, such as an open or cased wellbore. The tool 12 is suspended on a cable 13, inside steel casing 11. This steel casing sheathes the borehole 10 and is supported with cement 10*b*. The borehole 10 is typically filled with a completion fluid or water. The cable length substantially determines the depths to which the tool 12 can be lowered into the borehole. Depth gauges can determine displacement of the cable over a support mechanism (sheave wheel) and determines the particular depth of the logging tool 12. The cable length is controlled by a suitable known means at the surface such as a drum and winch mechanism (not shown). Depth may also be determined by electrical, nuclear or other sensors which correlate depth to previous measurements made in the well or to the well casing. Also, electronic circuitry (not shown) at the surface represents control communications and processing circuitry for the logging too 12. The circuitry may be of known type and does not need to have novel features.

in the embodiment of FIG. 3, the tool 12 shown has a generally cylindrical body 17 which encloses an inner housing 14 and electronics. Anchor pistons 15 force the tool-packer 17*b* against the casing 11 forming a pressure-tight, seal between the tool and the casing and serving to keep the tool stationary.

The inner housing 14 contains the perforating means, testing and sampling means and the plugging means. This Inner housing is moved along the tool axis (vertically) by the housing translation piston 16. This movement positions, in succession, the components of each of these three systems over the same point on the casing.

A flexible or flex shaft 18 is located inside the inner housing and conveyed through guide plates 14*b* which are integral parts of this inner housing. A drill bit 19 is rotated via the flexible shaft 18 by the drive motor 20. This motor is held in the inner housing by a motor bracket 21, which is itself attached to a translation motor 22. The translation motor moves the inner housing by turning a threaded shaft 23 inside a mating nut in the motor bracket 21. The flex shaft translation motor provides a downward force on the flex shaft during drilling, thus controlling the penetration. This drilling system allows holes to be drilled which are substantially deeper than the tool diameter.

Other techniques for perforating are also available. For example, technology exists that can produce perforations of a depth somewhat less than the diameter of the tool. In this approach (not shown), the drill bit is fitted directly to a right-angle gearbox, both of which are packaged perpendicular to the axis of the tool body. The gearbox and drill bit must fit inside the borehole. The length of a drill bit is limited because the gearbox occupies approximately one-half the diameter of the borehole. This system also contains a drive shaft and a flowline For the purpose of taking measurements and samples, a measurement-packer 17*c* and flow line 24 are also contained in the inner housing. After a hole has been drilled, the housing translation piston 16 shifts the inner housing 14 to move the measurement-packer into position over the drilled hole. The measurement packer setting piston 24*b* then pushes the measurement packer 17*c* against the casing thereby forming a sealed conduit between the drilled hole and flowline 24. The formation pressure can then be measured and a fluid sample acquired, if that is desired. At this point the measurement-packer may be retracted.

Finally, a plug magazine 26 is also contained in the inner housing 14. After formation pressure has been measured and samples taken, the housing translation piston 16 shifts the inner housing 14 to move the plug magazine 26 into position over the drilled hole. A plug setting piston 25 then forces one plug from the magazine into the casing, thus resealing the drilled hole. The integrity of the plug seal may be tested by once again moving the inner housing so as to reposition the measurement-packer over the plug, then actuating this packer hole and monitoring pressure through the flowline while a "drawdown" piston is actuated dropping and remaining constant at this reduced value. A plug leak will be indicated by a return of the pressure to the flowline pressure found after actuating the drawdown piston. It should be noted that this same testing method can be used to verify the integrity of the tool-packer seal before drilling commences. However, for this test the measurement-packer is not set against the casing, thus allowing the drawdown to be supported by the tool-packer. The sequence of events is completed by releasing the tool anchors. The tool is then ready to repeat the sequence starting.

Flexible Shaft

The flex shaft is a well known machine element for conveying torque around a bend. It is generally constructed by helically winding, in opposite directions, successive layers of wire over a straight central mandrel wire. The flex shaft properties are tailored to the specific application by varying the number of wires in each layer, the number of layers, the wire diameter and the wire material. In this particular application the shaft must be optimized for fatigue life (number of revolutions), minimum bend radius (to allow packaging in the given tool diameter) and for conveying thrust.

Another concern is the shaft reliability when applying thrust to the drill bit through the shaft. During drilling operations various amounts of thrust are applied to the drill bit to facilitate drilling. The amount of thrust applied depends on the sharpness of the bit and the material being drilled. Sharper bits only require the application of minimum thrust through the flexible shaft. This minimum thrust has virtually no affect on the reliability of the flexible shaft. Duller bits require the application of more thrust that could damage the flexible shaft. One solution is to apply the thrust directly to the drill bit instead of through the flexible shaft. In this method, force applied to a piston located in the tool is transferred by the piston to the drill bit. The thrust necessary for drilling is supplied without any effect on the flexible shaft. This technique is further described in a U.S. Pat. No. 5,687,806. A second solution is to use a sharp bit each time a drilling operation occurs. Multiple bits can be stored in the tool and a new bit used for each drilling procedure. As previously stated, the amount of thrust required by sharper bits has minimal affect on the flexible shaft. This technique is further described in a U.S. Pat. No. 5,746,279.

Guideplates

When the flex shaft is used to convey both torque and thrust, as it is in this application, some means must be provided to support the shaft to prevent it from buckling from the thrust loading applied through the flex shaft to the drill bit. In this embodiment of the invention, this support is provided by the mating pair of guide plates. These plates form the "J" shaped conduit through which the flex shaft passes. Forming this geometry from a pair of plates is a practical means of fabrication, and an aid in assembly, but is not strictly necessary for functionality. A "J" shaped tube could serve the same function. The inner diameter formed from the pair of plates is only slightly larger than the diameter of the flex shaft. This close fit minimizes the helical windup of the flex shaft in high torque drilling situations and it also maximizes the efficiency with which torque can be conveyed from the drive to the drill bit. The guideplate material is chosen for compatibility with the flex shaft. A lubricant can be used between the flex shaft and the guideplates.

Drillbit

The drillbit used in this invention preferably possesses several traits. In cased wellbore applications, it should be tough enough to drill steel without fracturing the sharp cutting edge. It is also preferably hard enough to drill abrasive formations without undue dulling. The tip geometry may provide torque and thrust characteristics which match the capabilities of the flexible drive shaft. It may also have a fluting capable of moving drill cuttings out of a hole many drill-diameters deep. The drill is preferably capable of drilling a hole sufficiently straight, round and not oversized so that the metal plug can seal it, if desired.

Figure 4A:
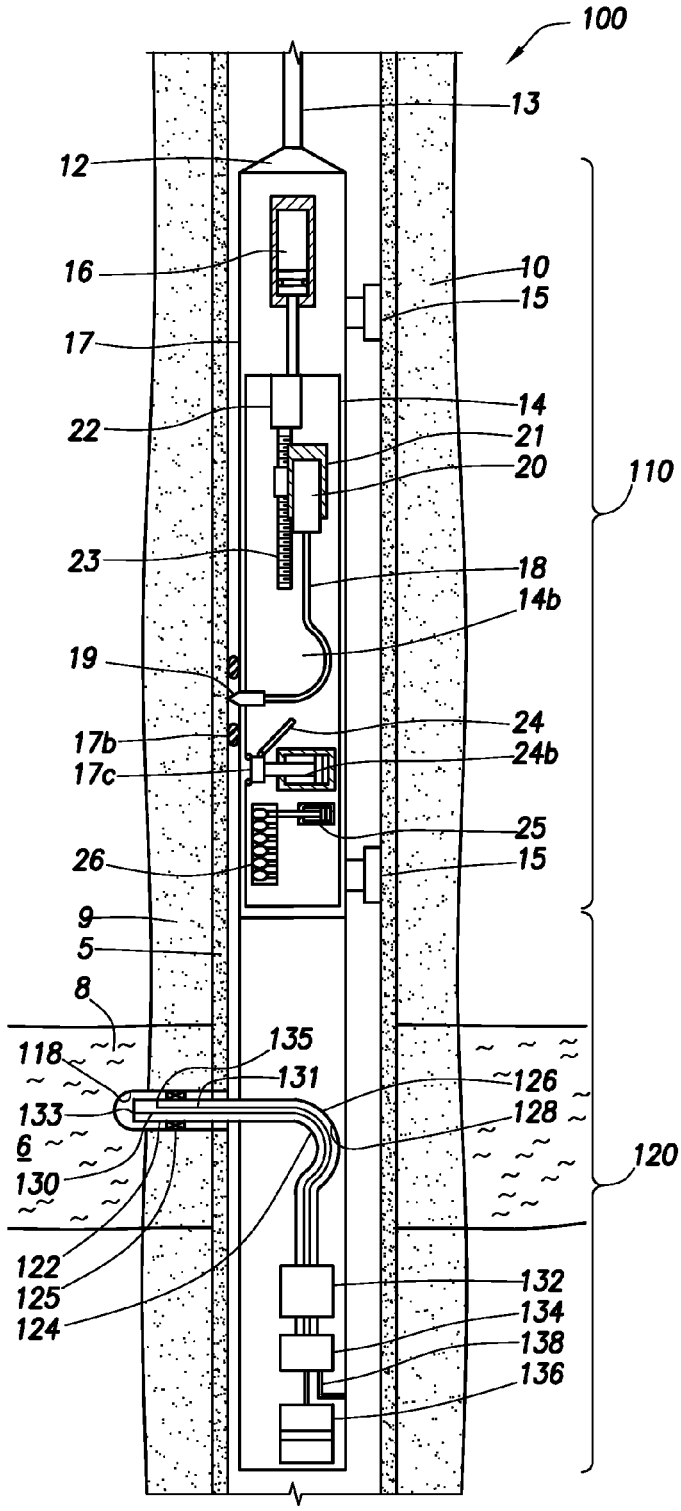
FIG. 4A is a schematic view of the downhole tool of FIG. 3 provided with the perforating system of FIG. 3, and a sampling system.

FIG. 4A depicts a downhole sampling system 100 including a perforating system 110, and a probe system 120. The perforating system 110 is depicted in FIG. 4A as being the same as the system described in FIG. 3. However, any perforating system may be used, such as explosive, punching, hydraulic or other mechanisms. Preferably, such a perforating system is capable of penetrating the sidewall (with or without casing and/or cement) to create a perforation extending from the borehole to the formation. For example, the perforating system may incorporate a drill bit mechanism such as those described in U.S. Pat. No. 5,692,565 assigned to the assignee of the present invention and incorporated herein by reference in its entirety.

The perforating system 110 is preferably adapted to perforate the sidewall of the wellbore and the casing and cement (if present). The perforation preferably extends through the sidewall of the wellbore, past the invaded zone 9 and into the connate fluid zone 8. However, in some cases, the perforation may not extend beyond the invaded zone and into the connate fluid zone of the formation.

The probe system 120 is depicted as being operatively connected to the perforating system in the same tool. However, it will be appreciated that the perforating and probe systems may be in separate tools or in a variety of positions in the same tool. The tool may be unitary or modular and contain these and other downhole systems. The apparatus may be positioned in any downhole tool, such as wireline, coiled tubing, autonomous, drilling and other variations of downhole tools. The tool may be provided with a variety of downhole modules and/or components, which may include devices such as probes, packers, sample chambers, pumps, fluid analyzers, actuators, hydraulics, electronics, among others.

The probe system includes a penetrating probe or shaft 122 extendable from the downhole tool via flexible shaft 124. The flexible shaft is supported in a guide 126 having a channel 128 therein. The penetrating probe 122 and flexible shaft are advanced and retracted through the guide using a drive motor, bracket, threaded shaft and mating nut (not shown) in the same manner as previously described for the flexible shaft 18 of FIG. 3.

The penetrating probe 122 is a tube that is extendable into a perforation 118 in the open wellbore. The perforation 118 may have been created by the perforating system 110, or by alternate perforating means. The perforation 118, as depicted, extends through the mudcake 5, invaded zone 9 and into the connate fluid zone 8 of formation 6. A distal end of the probe 122 extends into the perforation past the invaded zone 9 and into the connate fluid zone 6. A packer 125 is positioned about the penetrating probe 122 to isolate a portion of the probe during sampling. The mudcake 5 extends into the perforation and lines the surface thereof to provide an additional barrier from contamination of the connate fluid zone by the fluid in the wellbore.

A sampling flowline 130 and a cleanup flowline 131 are positioned through the penetrating probe and flexible shaft. The sampling flowline preferably has an opening 133 positioned at or near the distal end of the penetrating probe to obtain samples of clean formation fluid from the connate fluid zone. The clean up flowline preferably has an opening 135 a distance from the distal end of the penetrating probe to draw contaminated fluid from the Invaded zone into the downhole tool and away from the opening 133 of the sampling probe. Various combinations and positions of one or more sampling and/or cleanup flowlines and associated openings may be provided.

As shown in FIG. 4A, the sampling flowline is positioned such that the opening is adjacent the connate zone formation 8, and the opening for the cleanup flowline is positioned adjacent the invaded zone 9. In some cases, the opening 133 of the sampling flowline may not reach into the connate fluid zone. In such cases, it may be necessary to allow contaminated fluid to flow through the sampling flowline until the clean fluid breaks through and enters the sampling flowline.

A fluid analysis device 132 is preferably operatively connected to the flowlines. The fluid analysis device is adapted to analyze the fluid in the sampling and/or cleanup flowlines to determine the content of the fluid. Any fluid analysis device, such as the devices disclosed in U.S. Pat. Nos. 6,178,815 to Felling et al. and/or 4,994,671 to Safinya et al., the entire contents of which are hereby incorporated by reference, may be used. Other measuring devices may also be used in place of or in conjunction with a fluid analyzer, such as sensors, gauges, calipers or other downhole data collection devices.

As fluid passes through the fluid analyzer, the fluid analyzer may determine whether clean or contaminated fluid is in the flowline. Based on the information provided, a processor or other system may be used to make decisions concerning the sampling process. The fluid may then be selectively diverted into a sample chamber or out a port and into the wellbore. Alternatively, such decisions may be based on any criteria, or taken at intervals based on various criteria. The decision making may be made automatically or manually, at the surface or downhole or combinations thereof.

A pump 134 and associated hydraulics (not shown) are also preferably provided to selectively draw fluid into the flowlines. One or more pumps may be used. The pump(s) may be used to selectively draw fluid into one or both flowlines at simultaneous or varied flow rates and/or pressures. The selective flow of fluid into these flowlines may be used to manipulate the selective intake of clean and contaminated fluids to optimize the flow of clean fluid into the downhole tool.

One or more sample chambers 136 are preferably provided to capture samples of clean fluid collected in the flowline(s). The sample chambers may be any type of sample chambers using associated valving and flowlines for manipulation of sampling pressures. Such techniques of capturing samples are described, for example, in U.S. Pat. Nos. 4,860,581 and 4,936,139, both assigned to the assignee of the present invention.

At least one flowline may be operatively connected to the sample chambers. At least one flowline may also extend through the downhole tool and out an exit port 138. In this manner, the clean fluid is passed through flowline 130 and into sample chamber 136, and contaminated fluid is passed through cleanup flowline 131, out exit port 138 and back into the wellbore. Additional flowline connections and valving can be provided to allow fluid to be selectively diverted into the wellbore and/or sample chambers as desired. Typically, such decisions are based on the data received by the fluid analyzer 132 or other criteria.

The penetrating probe may also be provided with sensors and/or gauges adapted to take downhole measurements. Information derived from the penetrating probe may be used to analyze and/or make decisions concerning the downhole operations. Wired or wireless communications may be used to pass signals between the penetrating probe, the downhole tool and/or a surface unit. Such signals may include data, communication and/or power signals. Techniques for communication with a deployed probe are described, for example, in U.S. Pat. No. 6,693,553, assigned to the assignee of the present invention.

Once the perforation is created, the penetrating probe is preferably positioned in the perforation such that the sampling flowline extends beyond the invaded zone and the cleanup flowline is positioned at or near the invaded zone. The sampling flowline may (at least initially) receive contaminated fluid. In such cases, the fluid in one or both of the flowlines may be dumped to the wellbore. After some of the contaminated fluid is cleared out and the clean fluid breaks through, the sampling flowline will then begin to collect cleaner fluid from the formation. The cleanup flowline assists in removing contaminated fluid and allowing the break through of the clean fluid to reach the sampling flowline. If sufficient cleanup is completed, the cleanup flowline may also break through to clean fluid. In such cases, one or both of the flowlines may be used for sampling if desired.

Figure 4B:
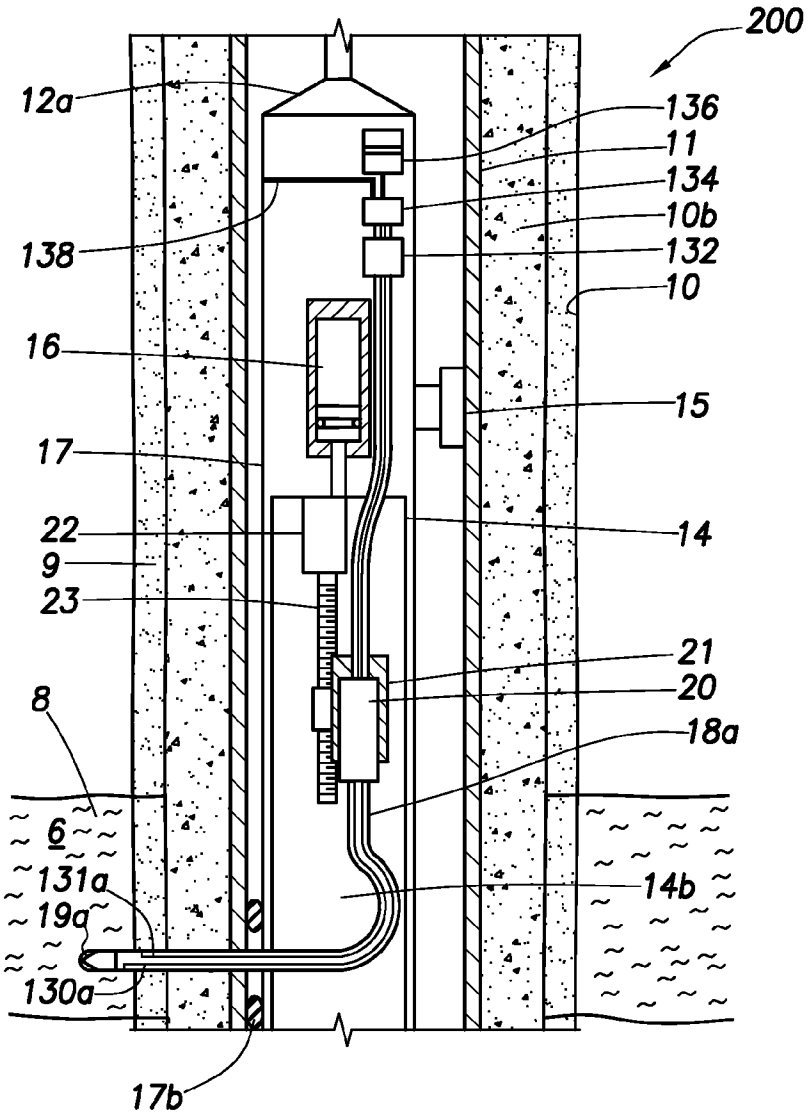
FIG. 4B is a schematic view of an alternate embodiment of the downhole tool of FIG. 4A with a combined perforating and sampling system.

FIG. 4B depicts an alternate embodiment of a sampling system 200 disposed in a downhole tool 12*a*. The sampling system 200 is the same as the perforating system of FIG. 3, except that the perforating system includes a sampling system integral therewith. The flexible shaft 18*a* has a sampling flowline 130*a* and a cleanup flowline 131*a* extending therethrough. A packer 17*b* is positioned about the shaft 18*a* to isolate at least a portion of the perforation. The flowlines extend through bit 19*a* and draw fluid into the tool at various positions in the formation. Preferably, the sampling flowline is positioned to draw clean fluid from the formation and the cleanup flowline is positioned to draw contaminated fluid away from the sampling flowline as previously described with respect to FIG. 4A.

The flowlines in this embodiment extend from bit 19*a*, through flexible shaft 18*a*, and past motor 20 and motor bracket 21. Fluid is pumped via pump 134 and passes through fluid analyzer 132 and either out port 138 or into sample chamber 136 in the same manner as described previously with respect, to FIG. 4A. It will be appreciated that the flowlines may be positioned through the bit, along the shaft, through the downhole tool or about other positions as desired.

While FIGS. 4A and 4B show specific configurations utilizing a downhole perforating system and sampling system in open or cased wellbores, it will be appreciated that a variety of configurations may be employed. For example, a variety of one or more drill bits, flexible shafts, flowline arrangements and other features and combinations may be used. Such configurations, variations or combinations may be used in either open or cased wellbores.

Referring now to FIGS. 5A-5E, a variety of penetrating probes are depicted. These probes may be used, for example, in the sampling systems of FIGS. 4A and 4B. Each of the probes is depicted as extending from a downhole tool (300*a*-*e*) into a perforation 302 in a wellbore. The perforation may extend from a open wellbore or a wellbore having casing and cement. For simplicity, the perforations of FIGS. 5A-E will be depicted in an open wellbore.

Figure 5A:
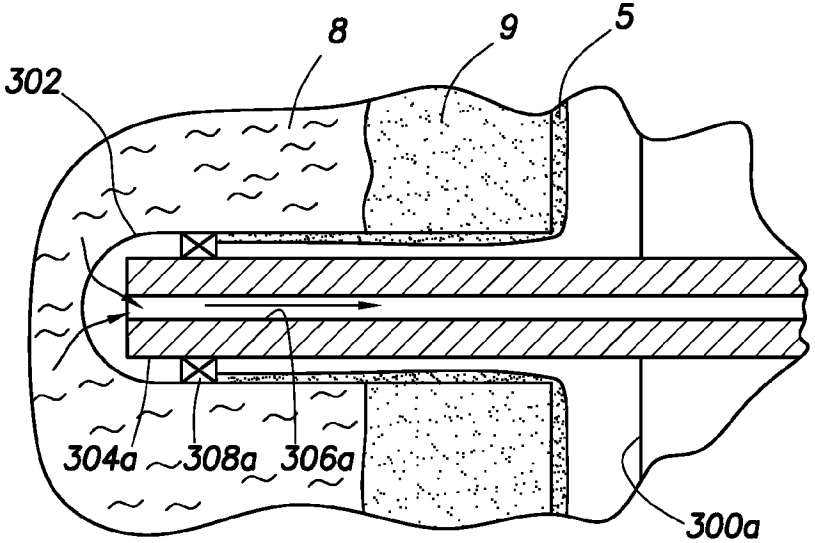
FIG. 5A is a detailed, schematic view of the penetrating probe of FIG. 4A having a sampling flowline and a packer.

The probe of FIG. 5A is a tubular probe 304*a* positioned in a downhole tool 300*a* and having a flowline 306*a* therein. The flow channel is operatively connected to a pump (FIG. 4A or 4B) for drawing fluid into the downhole tool. The extended probe could be a cylindrical tube extended into the perforation, or a drill bit that creates the perforation. The perforation preferably extends through the invaded zone 9, and into the connate fluid zone 8. Mudcake 5 lines the wellbore and extends into the perforation to line the surface thereof.

A packer 308*a* is preferably positioned about the probe to isolate the distal end of the probe from the wellbore and the remainder of the perforation. The packer 308*a* is selectively inflatable about the tube. Typically, the packer is expanded after insertion of the tubular probe into the perforation. The packer may be deflated to facilitated insertion and/or removal of the perforating probe through the perforation. Techniques for inflating packers are known and described, for example in U.S. Patent Nos. U.S. Pat. Nos. 4,860,581 and 4,936,139, both assigned to the assignee of the present invention.

The packer sealingly engages the perforation to isolate a portion of the perforation near the distal end of the probe. Preferably, the probe Is extended into the sidewall of the wellbore beyond the invaded zone 9 such that the distal end of the probe is isolated within the formation. The seal prevents the flow of contaminated fluid from the wellbore or invaded zone into the sampling flowline, and permits the flow of clean fluid from the connate fluid zone of the formation into the sampling flowline.

When the probe and packer are in place, the distal end of the perforation 302 is isolated from the wellbore and the remainder of the perforation. The packer isolates the distal end of the probe and prevents the flow of fluid from the distal end of the perforation to the remainder of the wellbore. As fluid flows into the sampling flowline, the fluid is prevented from flowing into the remainder of the perforation, it may be necessary to clear out some contaminated fluid before the clean fluid will reach the distal end of the perforation. The packer assists in creating a barrier to the entry of fluid from the invaded zone 9 into the distal end of the perforation and into the sampling flowline. Once the desired fluid has been collected, the sampling process may be terminated.

Figure 5B:
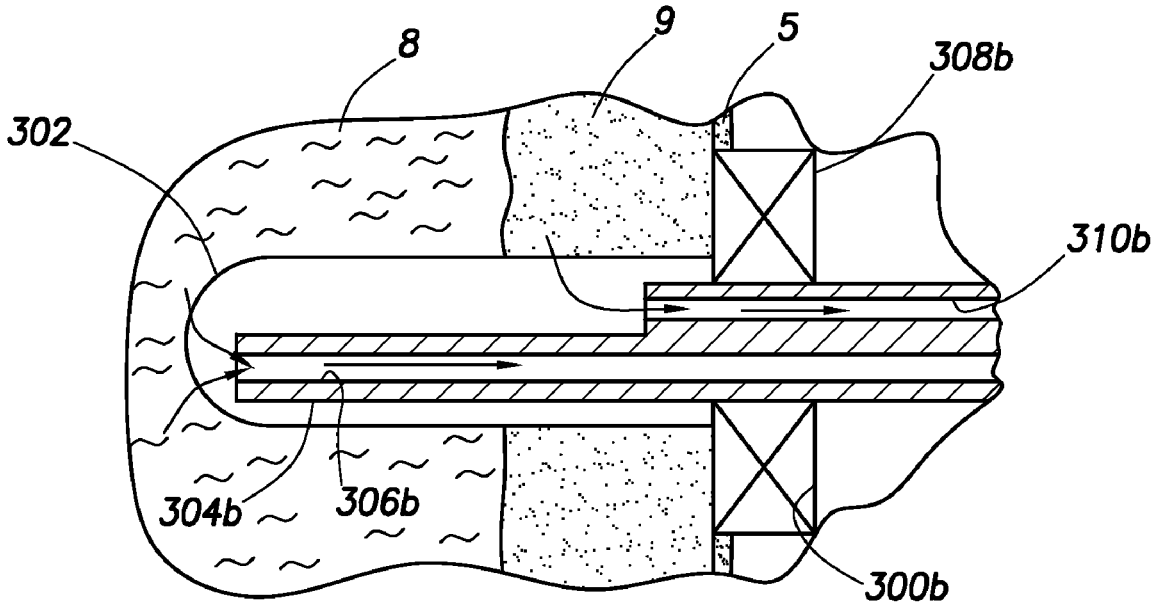
FIG. 5B is a schematic view of an alternate embodiment of the penetrating probe of FIG. 5A having a sampling flowline and a clean up flowline, with the packer positioned adjacent the downhole tool.

FIG. 5B shows an alternate embodiment of a penetrating probe 304*b*. In this embodiment, the packer 308*b* is positioned between the downhole 300*b* tool and the sidewall of the wellbore. The packer 308*b* is disposed about the probe 304*b* to isolate the probe from wellbore fluids.

A sampling flowline 306*b* extends through the tube to draw fluid into the downhole tool. A cleanup flowline 310*b* is provided in the downhole tool to draw fluid into the downhole tool. Preferably, the sampling flowline 306*b* has an opening positioned near the distal end of the penetrating probe to sample clean formation fluid. The cleanup flowline has an opening positioned a distance from the distal end of the probe to draw contaminated fluid away from the sampling flowline as indicated by the arrows. As depicted, the cleanup flowline is preferably at or near the downhole tool.

Fluid from the invaded zone 9 is drawn into the cleanup flowline to prevent it from flowing toward the distal end of the probe and entering the sampling flowline 306*b*. Thus, the fluid near the sampling flowline contains clean fluid from the connate fluid zone 8. As a result, contaminated fluid is drawn away from the sampling flowline such that the sampling flowline may collect clean fluid. The flowlines are preferably arranged to minimize the time required to obtain a pure and clean sample of the connate fluid in the connate fluid zone. In other words, the flowrates in the flowlines may be adjusted to facilitate the flow of clean fluid into the tool.

Figure 5C:
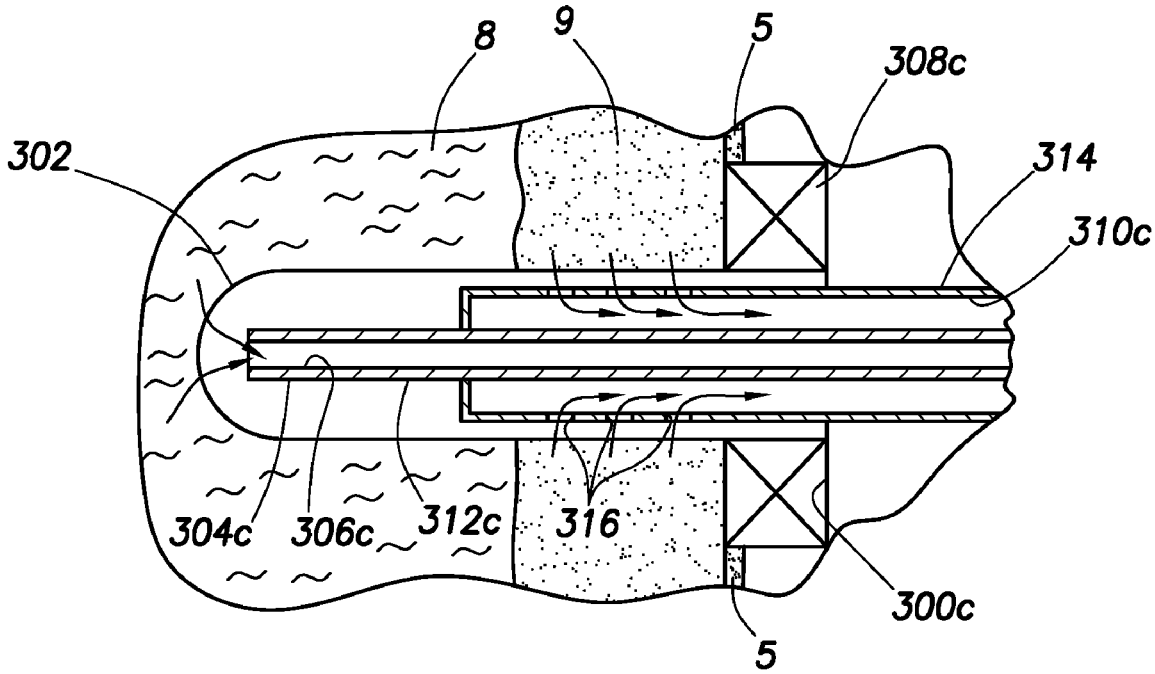
FIG. 5C is a schematic view of an alternate embodiment of the penetrating probe of FIG. 5A having an inner flow tube with the sampling flowline therein and an outer flow tube with a cleanup flowline therein.

FIG. 5C depicts a perforating probe 304*c* disposed in downhole tool 300*c* and having a sampling flowline 306*c* extending through an inner tubular portion 312*c*. A cleanup flowline 310*c* is positioned in an outer tubular portion 314 disposed about the inner tubular portion. The outer tubular portion is provided with a plurality of ports 316 (one or more may be used) for drawing contaminated fluid therein, A packer 308*c* is positioned about the downhole tool 300*c* to isolate the perforation from the wellbore.

The tubular portions may be unitarily extended and retracted from the downhole tool as depicted in FIG. 4A. Alternatively, the tubular portions may be telescopically extendable and retractable via a hydraulic actuator (not shown). This permits selective positioning of the flowlines within the perforation.

The sampling tube 304*c* extends into the perforation 302 such that the distal end of the probe extends into the connate zone 8 of the formation. The outer tubular portion 314 is selectively extended into the perforation about the probe. The outer tubular portion is preferably positioned in the invaded zone 9 to draw contaminated fluid into the cleanup flowline and away from the sampling flowline. One or more ports in the outer tubular portion are positioned to facilitate the flow of contaminated fluid into the cleanup flowline and away from the sampling flowline.

Figure 5D:
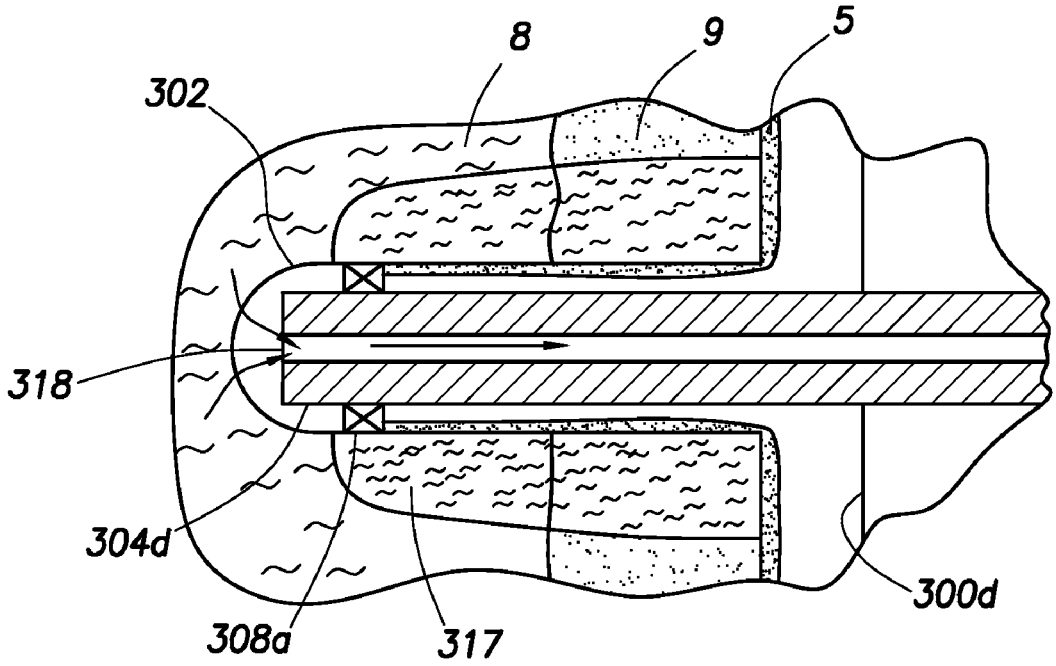
FIG. 5D is a schematic view of an alternate embodiment of the penetrating probe of FIG. 5A extending into a perforation treated with an injecting fluid.

FIG. 5D is the same as FIG. 5A, except that the perforation is treated with an injecting fluid 317. Penetrating probe 304*d* positioned in downhole tool 300*d* is positioned in the treated perforation. In this case, the injecting fluid is inserted into the formation adjacent, perforation 302 to create a seal therein. The injecting fluid may be a viscous material or a material adapted to prevent the flow of fluid therethrough. The injecting fluid preferably becomes more viscous over time or solidifies in the formation. For example, a moderately low viscosity epoxy could be used as a suitable sealing fluid. The injecting fluid may be inserted during perforation and/or sampling via known injecting devices.

The injecting fluid creates a barrier and prevents fluid from flowing into the perforation 302. Preferably, the injecting fluid extends about the perforation in the invaded zone 9. Preferably, the injected fluid prevents fluid in the wellbore and/or invaded zone from flowing into the perforation. The injected fluid also prevents clean fluid from passing from the perforation and into the invaded zone or wellbore. Thus, as depicted in FIG. 5D, the distal end of the perforation extends into the connate fluid zone 8 and is isolated from the invaded zone 9.

The penetrating probe 304*d* is positioned such that an opening 318 of the probe is positioned a distance beyond the injecting fluid. The packer 308*a* is expanded such that it isolates the distal end of the perforation from the remainder of the wellbore. The packer and the Injecting fluid prevent fluid from the wellbore and invaded zone from reaching the opening 318. As a result, fluid from the connate fluid zone flows into the sampling flowline through the distal end of the perforation. In this manner, the flow of clean fluid from the formation into the sampling flowline is facilitated, and the flow of contaminated fluid into the sampling flowline is prevented.

Figure 5E:
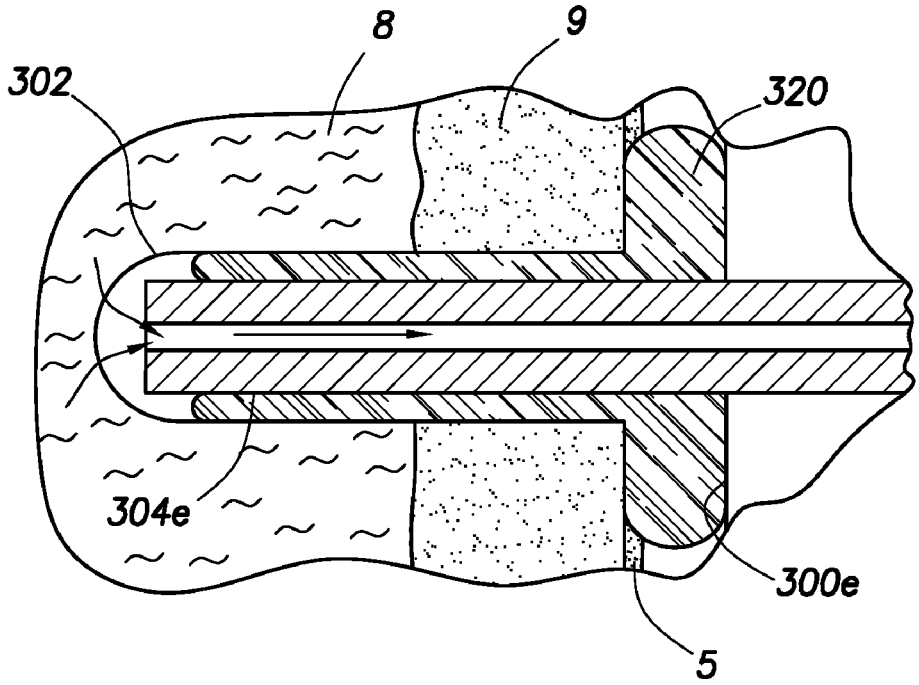
FIG. 5E is a schematic view of an alternate embodiment of the penetrating probe of FIG. 5A with a flow inhibitor positioned thereabout.

FIG. 5E depicts a penetrating probe 304*e* positioned in downhole tool 300*e* and provided with a flow inhibitor 320. The flow inhibitor is injected into the perforation 5E to fill the annular space between the probe and the perforation 302, The flow inhibitor 320 can be a viscous fluid or other such material that hardens over time, similar to the injected fluid previously described with respect to FIG. 5D. The flow inhibitor preferably flows into the annular space about the probe to fill the gap between the perforation and the perforating probe. A seal is preferably formed about the flow inhibitor to prevent wellbore or invaded zone fluid from entering the distal end of the penetrating probe.

The sampling flowline of the penetrating probe is selectively positioned in the perforation to obtain samples of clean formation fluid. The probe may be inserted into the perforation before, after or simultaneously with the fluid inhibitor. The distal end of the probe preferably extends beyond the flow inhibitor and into the connate fluid zone 8 such that clean formation fluid may enter the sampling flowline. The fluid inhibitor preferably blocks the perforation to prevent contamination of the fluid flowing into the sampling flowline.

The embodiments of FIGS. 5A-5E depict a variety of configurations for penetrating probes. It is appreciated that the sampling flowline of the probes is adapted for positioning in the downhole tool to draw clean fluid into the downhole tool. Isolation features, such as the packers, injection fluid, flow inhibitor and cleanup flowlines are preferably provided to assist in preventing contaminated fluids from mixing with sampled fluids as they are drawn into the sampling flowline. Other techniques for achieving this may also be envisioned. For example, various combinations of one or more of the described probes, packers, flowlines, injection fluids and/or restrictors may be used. The flowlines and associated devices may be arranged to facilitate flow of clean fluid into the sampling flowline and contaminated fluid into the cleanup flowline. The arrangement also preferably separates the clean fluid from further contamination. Additionally, the arrangement and flowrates may be adjusted to minimize the time required to obtain a pure and clean sample of the connate fluid in the connate fluid zone and/or to maximize the quantity of clean fluid collected.

Referring now to FIGS. 6A-6D, a perforating probe (400*a, b, c, d*) is provided. The perforating probe (400*a, b, c, d*) may be used, for example, in the sampling systems of FIGS. 4A and 4B. The perforating probe is adapted to perforate the sidewall of the wellbore and create a perforation 402. The perforating probe is preferably capable of penetrating the sidewall of an open wellbore, or a wellbore having casing and cement. For description purposes, a wellbore having casing and cement is depicted in FIGS. 6A-6D.

Figure 6A:
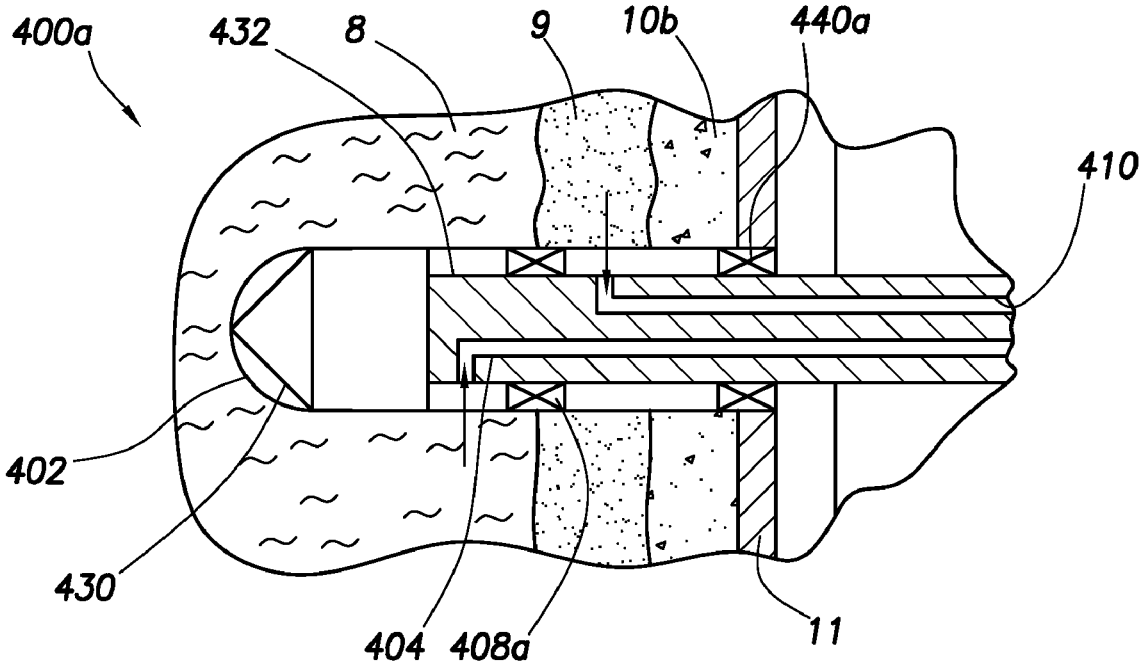
FIG. 6A is a detailed, schematic view of the perforating probe of FIG. 4B having a pair of packers disposed along the penetrating probe.

The perforating probe 400*a* is provided with a bit 430 adapted to penetrate the sidewall of an open or cased wellbore. As shown in FIG. 6A, bit 430 extends through casing 11, cement 10*b*, the invaded zone 9 and connate fluid zone 8 to create a perforation 402. Preferably, the bit is advanced approximately transversely into the sidewall to create a perforation such that a distal end of the perforation is located at least in the invaded zone 9, and preferably into the connate zone 8. The bit is extended from the downhole tool and driven through the sidewall of the wellbore via a flexible shaft 432 as previously described with respect to FIG. 4B.

The perforating probe 400*a* is also provided with a sampling flowline 404 and a cleanup flowline 410 to draw fluid into the downhole tool. The sampling flowline 404 is preferably positioned at or near the distal end of the perforating probe 400*a* so that it extends beyond the invaded zone 9 and into the formation to reach the clean formation fluid in the connate zone 8, The cleanup flowline 410 is preferably positioned a distance from the bit to draw contaminated fluid away from the sampling flowline.

One or more packers may be positioned about the perforating probe 400*a* to isolate portions of the perforating probe. For example, as shown in FIG. 6A, a packer 408*a* is positioned between the sampling and cleanup flowlines to prevent contamination therebetween, A second packer 440*a* is positioned about the probe between the cleanup flowline and the wellbore to prevent the flow of wellbore fluids into the perforation.

Figure 6B:
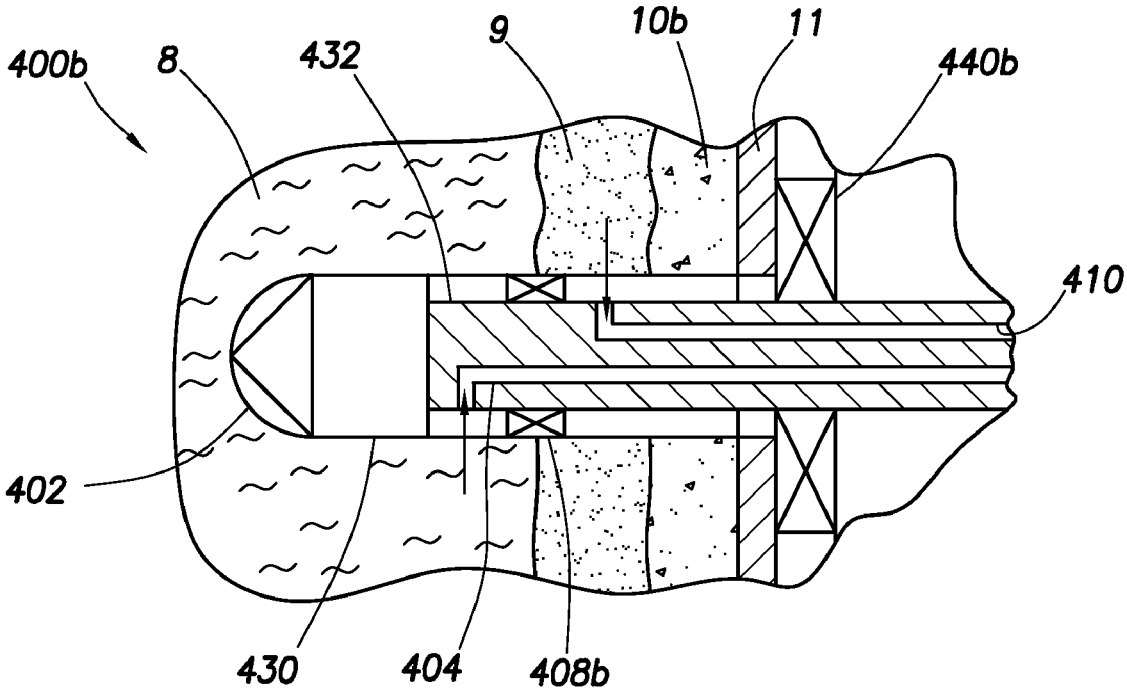
FIG. 6B is an alternate embodiment of the perforating probe of FIG. 6A wherein one of the packers is positioned about the downhole tool.
Figure 6C:
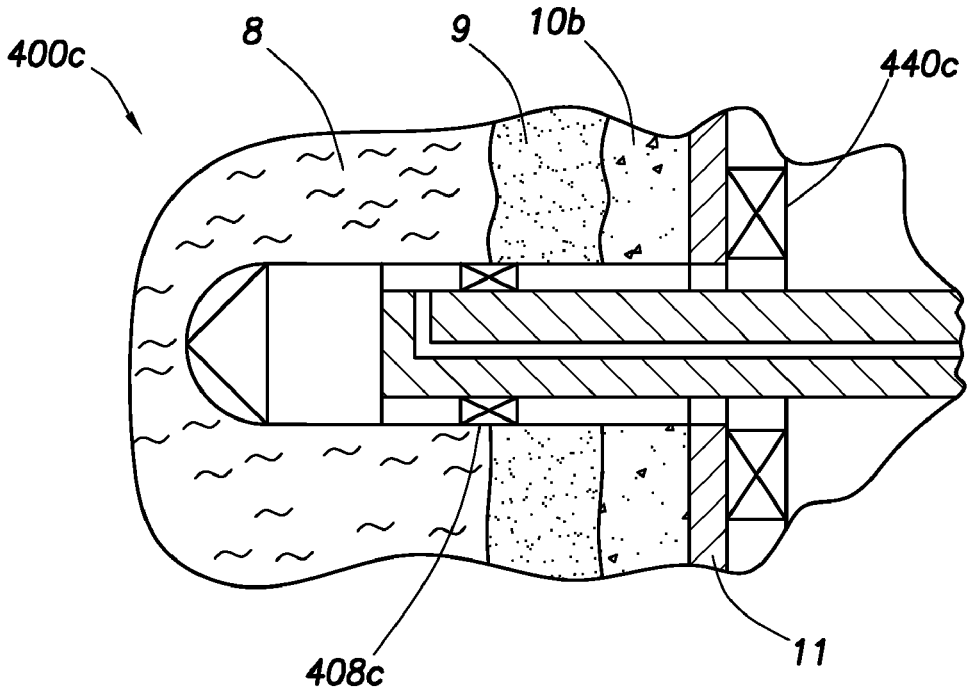
FIG. 6C is an alternate embodiment of the perforating probe of FIG. 6A without a cleanup flowline.
Figure 6D:
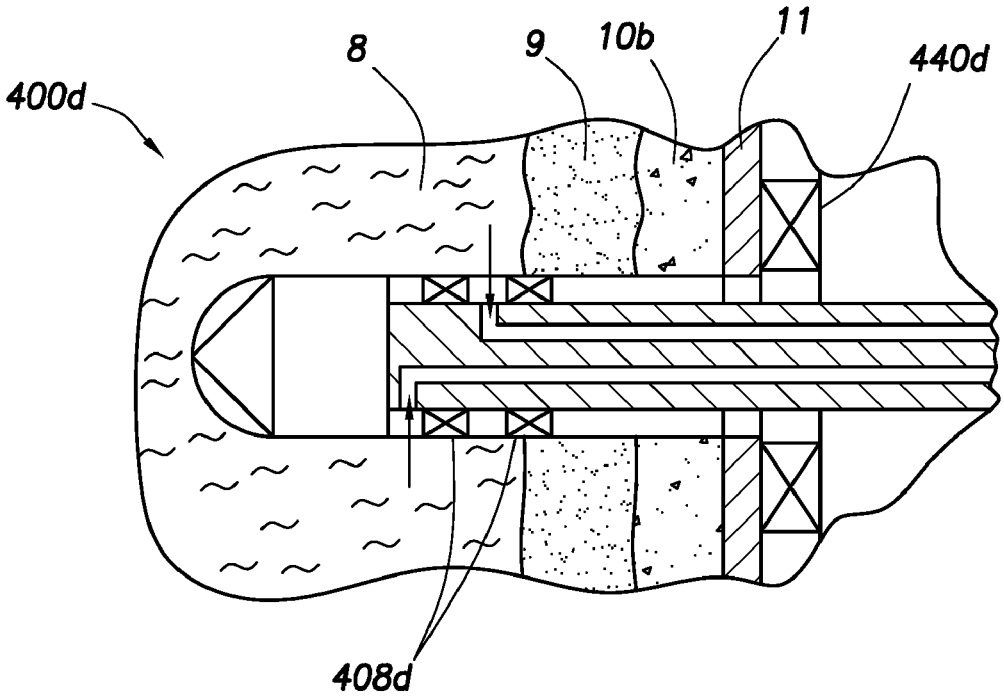
FIG. 6D is an alternate embodiment of the perforating probe of FIG. 6A having a pair of packers disposed along the penetrating probe and a packer positioned about the downhole tool.

FIGS. 6B-D depict alternate embodiments of the perforating probe (400*b-d*). As shown in FIG. 6B, the packer 408*b* is positioned about the penetrating probe 400*b* between the openings for the sampling and cleanup flowlines. The packer 440*b* is positioned about the probe adjacent the downhole tool and the sidewall of the wellbore to isolate the perforation from the wellbore. FIG. 6C, is the same as FIG. 6B, except that the penetrating probe 400*c* has no cleanup flowline. FIG. 6D is the same as FIG. 6B, except that an additional packer 408*d* is positioned along the penetrating probe 400*d* between the cleanup flowline and the downhole tool. As in FIG. 6B, the first packer 408*d* is positioned between the sampling and cleanup flowlines. Preferably, the additional packer 408*d* is positioned adjacent the connate and invaded zones to create a separation in the perforation therebetween. This probe and packer placement assists in creating a boundary between clean fluid entering the sampling flowline and contaminated fluid entering the cleanup flowline. However, other placement may be envisioned as necessary. A third packer 440*d* is positioned about the downhole tool to isolate the perforation from wellbore fluids.

The packers of FIGS. 6A-D are inflatable in the same manner as the packers of FIGS. 5A and 5B. A variety of packer, flowline and bit combinations and placements are envisioned. The placement of such combinations may also be combined with various features of the penetrating probe of FIGS. 5A-5E in cased or open wellbore operations. Preferably, a fluid restrictor, such as the packer, flow inhibitor and/or injected fluid assists in creating a barrier to prevent, contaminated fluid from flowing into the perforation from the wellbore or the formation surrounding the perforation. This barrier assists in assuring that contamination fluid is prevented from advancing into the distal end of the perforation and/or that clean fluid enters the perforation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A downhole sampling tool positionable in a wellbore penetrating a subterranean formation, the subterranean formation having a formation fluid therein, the wellbore having a contaminated fluid therein extending into an invaded zone about the wellbore, comprising:

a housing;

a shaft extendable from the housing, the shaft positionable in a perforation penetrating the formation beyond the invaded zone about the wellbore;

a flowline extending through the shaft and into the housing, the flowline having an inlet for receiving downhole fluids through the perforation; and a first fluid restrictor positioned at least in part outside of the perforation, the first fluid restrictor adapted to isolate the perforation from the wellbore fluids;

wherein the first fluid restrictor comprises a fluid injected into the formation about the perforation, the fluid adapted to penetrate the formation and create a seal about at least a portion of the perforation.

2. The sampling tool of claim 1 further comprising a second fluid restrictor about the shaft to isolate at least a portion of the perforation whereby contaminated fluid is prevented from entering an isolated portion of the perforation.

3. The sampling tool of claim 1 further comprising a bit at a distal end of the shaft, the bit adapted to penetrate a sidewall of the wellbore to create the perforation.

4. The sampling tool of claim 1 wherein the first fluid restrictor further comprises a viscous fluid injected at least in part in a portion the wellbore about the perforation.

5. The sampling tool of claim 1 further comprising a perforator adapted to create the perforation in the sidewall of the wellbore.

6. The sampling tool of claim 5 wherein the perforator is separate from the shaft.

7. A method of sampling a fluid from a subterranean formation penetrated by a wellbore, the subterranean formation having a formation fluid therein, the wellbore having a contaminated fluid therein extending into an invaded zone about the wellbore, comprising:

perforating a sidewall of the formation, the perforation penetrating the formation beyond the invaded zone about the wellbore;

inserting a shaft into a perforation in a sidewall of a wellbore, the shaft having a flowline extending through the shaft and into the housing, the flowline having an inlet for receiving downhole fluids through the perforation;

positioning a first fluid restrictor at least in part outside of the perforation whereby the perforation is isolated from the wellbore fluids, wherein positioning the first fluid restrictor comprises at least one of:

injecting a viscous fluid at least in part in the wellbore about the perforation; and injecting a fluid into the formation about the perforation; and drawing downhole fluid from the perforation into the downhole tool via the flowline.

8. The method of claim 7 further comprising positioning at least one packer against a sidewall of the wellbore about the perforation.

9. The method of claim 7 wherein the perforation is created by extending the shaft through the sidewall of the wellbore, the shaft being provided with a bit at an end thereof.

10. The method of claim 7 wherein the perforation is created through one of casing, cement, mudcake, formation and combinations thereof.

11. The method of claim 7 wherein the step of inserting and the step of perforating are performed separately.

12. The method of claim 7 further comprising selectively diverting fluid from the flowlines into one of a sample chamber in the downhole tool, the wellbore and combinations thereof.

13. The method of claim 7 further comprising taking downhole measurements using at least one sensor positioned about one of the shaft, the housing and combinations thereof.

14. The method of claim 7 further comprising analyzing the downhole fluid drawn from the perforation.

15. The method of claim 7 further comprising providing a second fluid restrictor about the shaft to isolate at least a portion of the perforation whereby contaminated fluid is prevented from entering an isolated portion of the perforation.

16. A downhole sampling tool positionable in a wellbore penetrating a subterranean formation, the subterranean formation having a formation fluid therein, the wellbore having a contaminated fluid therein extending into an invaded zone about the wellbore, comprising:

a housing;

a shaft extendable from the housing, the shaft positionable in a perforation penetrating the formation beyond the invaded zone about the wellbore;

a flowline extending through the shaft and into the housing, the flowline having an inlet for receiving downhole fluids through the perforation; and a first fluid restrictor positioned at least in part outside of the perforation, the first fluid restrictor adapted to isolate the perforation from the wellbore fluids;

wherein the first fluid restrictor comprises a viscous fluid injected at least in part in a portion the wellbore about the perforation.

17. The sampling tool of claim 16 further comprising a second fluid restrictor about the shaft to isolate at least a portion of the perforation whereby contaminated fluid is prevented from entering an isolated portion of the perforation.

18. The sampling tool of claim 16 further comprising a bit at a distal end of the shaft, the bit adapted to penetrate a sidewall of the wellbore to create the perforation.

19. The sampling tool of claim 16 further comprising a perforator adapted to create the perforation in the sidewall of the wellbore.

20. The sampling tool of claim 19 wherein the perforator is separate from the shaft.

* * * * *